US006371403B1

(12) United States Patent
Shen

(10) Patent No.: US 6,371,403 B1
(45) Date of Patent: Apr. 16, 2002

(54) TAPE HOLDER WITH A BEARING SHAFT

(76) Inventor: Dick Shen, No. 41-6, Ta Hu, Ta-Kang Tsun, Kuei-Shan Hsiang, Taoyuan Hsien (TW)

( * ) Notice: Subject to any disclaimer, the term of this patent is extended or adjusted under 35 U.S.C. 154(b) by 0 days.

(21) Appl. No.: 09/580,193

(22) Filed: May 26, 2000

(51) Int. Cl.[7] ..... B65H 49/26; B65H 19/12

(52) U.S. Cl. ..... 242/598.2; 242/597.5; 242/598.1; 225/47

(58) Field of Search ..... 242/598.2, 598.1, 242/597.5, 597.8; 225/46, 47

(56) References Cited

U.S. PATENT DOCUMENTS 4,059,210 A * 11/1977 Deering, Jr. ..... 225/47
5,228,612 A * 7/1993 Kuo et al. ..... 225/47
6,170,395 B1 * 1/2001 Lee ..... 101/288

* cited by examiner

*Primary Examiner*—Christopher P. Ellis
*Assistant Examiner*—Joseph C Rodriguez
(74) *Attorney, Agent, or Firm*—Bacon & Thomas PLLC

(57) ABSTRACT

A tape holder that includes space formed in the deck and a bearing-shaft seat mounted on a recess portion such that the bearing-shaft seat can be turned and uplifted for easy and rapid loading or replacing a tape reel.

5 Claims, 8 Drawing Sheets

PRIOR ART Fig. 1

TAPE HOLDER WITH A BEARING SHAFT

BACKGROUND OF THE INVENTION

1. Field of the Invention

This invention relates generally to tape holders, more particularly, it relates to a bearing shaft of tape holder, wherein a shaft seat can be pulled and uplifted for easy and rapid replacement of a tape reel.

2. Description of the Related Art

A conventional tape holder with sliding shaft of a disclosed U.S. Pat. No. 5,228,612 comprises: a deck; a store space formed in the deck; a recessed face formed in a lateral inner wall of the store space; a pair of horizontal groove cogs disposed on the recessed face; a retaining groove formed at a turning point between the recessed face and the inner wall; a recessed edge formed in another lateral inner wall of the store space at a position opposite to the recessed face; a bearing shaft provided with a pair of slide grooves pivotally collared onto the horizontal cog pair, and another pair of cogs, wherein one cog will choke at the retaining groove to thereby suspend the bearing shaft stably in the store space by sheathing the slide groove on the horizontal groove cogs and sliding to stride the recessed edge, another cog will prevent the bearing shaft from escaping when the latter is pulled outwards.

The abovesaid structure is imperfect in that it lacks an anchor mechanism for fixing the bearing shaft on the recessed face when it is pivotally collared on the recessed face, therefore, the bearing shaft cannot be delivered in or pulled out stably and smoothly by a user's hand.

Another conventional tape holder shown in FIG. 1 is characterized in:

The tape holder is provided with a circular recessed face 4 and a cylindrical bearing shaft 5, wherein the outer diameter of the cylindrical bearing shaft 5 must be coincident with the diameter of the recessed face 4 for pivotally disposing the former in the latter. However, because of expansion and shrinkage of the bearing shaft 5 in different temperature conditions, the outer diameter can hardly be controlled to meet expected value after die stripping.

SUMMARY OF THE INVENTION

The primary object of this invention is to provide an improved bearing shaft of tape holder for easy and rapid replacement of a tape reel.

Another object of this invention is to provide an improved bearing shaft of tape holder so that a tape reel can be replaced with least labor.

In order to realize abovesaid objects, a first and a second recess portion are formed respectively in two lateral walls of a store space in a deck body of a tape holder, wherein a pivotal joint portion is positioned on the second recess portion for pivotally jointing a bearing-shaft seat by taking advantage of a pivotal-joint pin so that a user can pull and uplift the bearing-shaft seat for easy and rapid replacement of a tape reel.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention to be made later are described briefly as follows in which.

DETAILED DESCRIPTION OF THE PREFERRED EMBODIMENT

Figure 1:
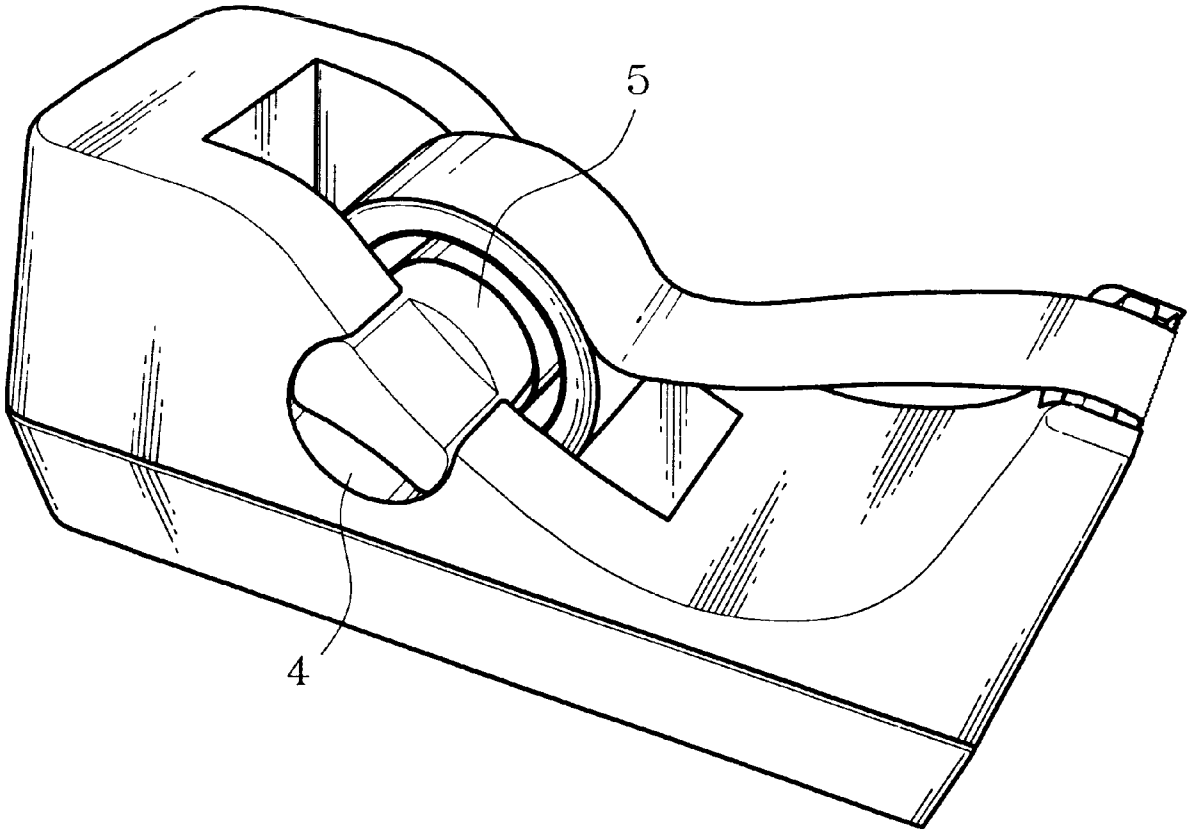
FIG. 1 is a schematic view of a conventional tape holder.
Figure 2:
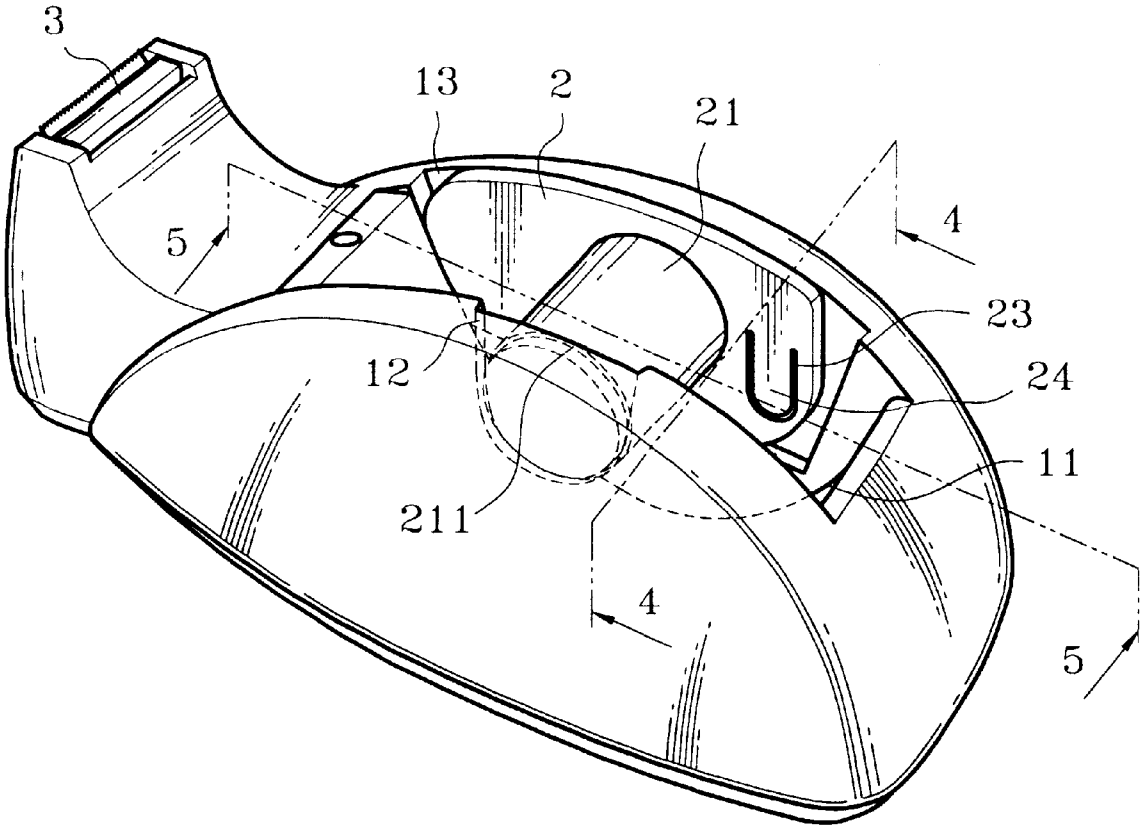
FIG. 2 is an elevational view of this invention in three dimensions.
Figure 3:
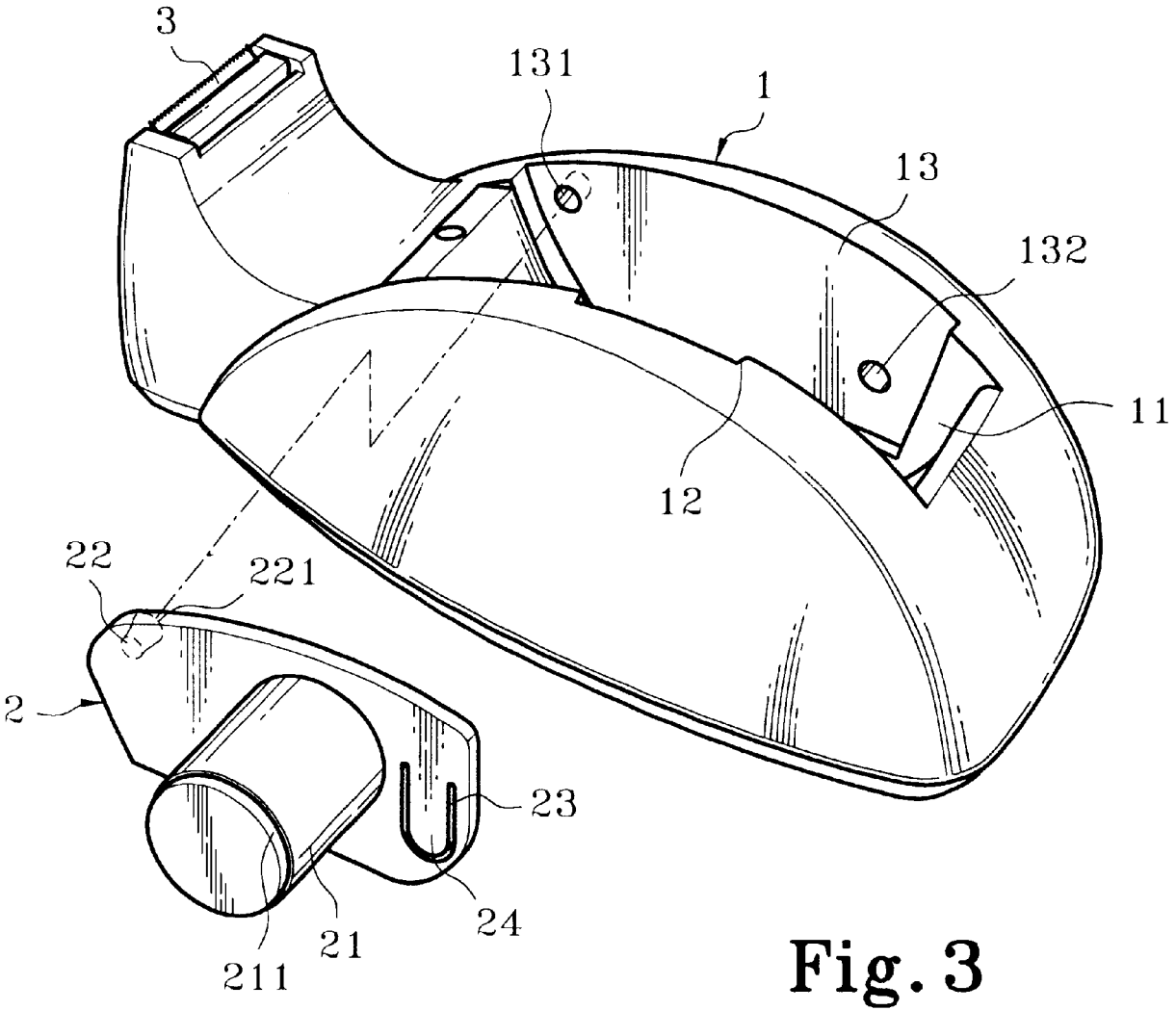
FIG. 3 is a structural exploded view of this invention.

As shown in FIG. 2 and FIG. 3, a tape holder of this invention comprises a deck 1, a bearing-shaft seat 2, and a cutting device 3 disposed at one end of the deck 1.

The deck 1 is evacuated to form a store space 11, wherein a first and a second recess portion 12, 13 are disposed in each of two lateral walls of the store space 11 respectively, and a pivotal joint portion 131 and a positioning portion 132 are arranged at proper positions of the second recess portion 13.

The bearing-shaft seat 2 is pivotally jointed with the pivotal joint portion 131, wherein a bearing shaft 21 is disposed at a lateral face of the bearing-shaft seat 2, and a free end of the bearing shaft 21 is extended to form a projecting portion 211; a pivotal joint shaft 22 is protruding on the other lateral face of the bearing-shaft seat 2, wherein a spherical face 221 is formed at a free end of the pivotal joint shaft 22, and the outer diameter of the spherical face 221 is slightly larger than the inner diameter of the pivotal joint portion 131 so that the former can be snap-retained in the latter to prevent the mounted bearing-shaft seat 2 from escaping. Besides, a scale slot 23 is made at one side of the bearing-shaft seat 2 adjacent to the bearing shaft 21 to form a flexible buckling portion 24 for fixing the bearing-shaft seat 2 to the tape holder.

Figure 4:
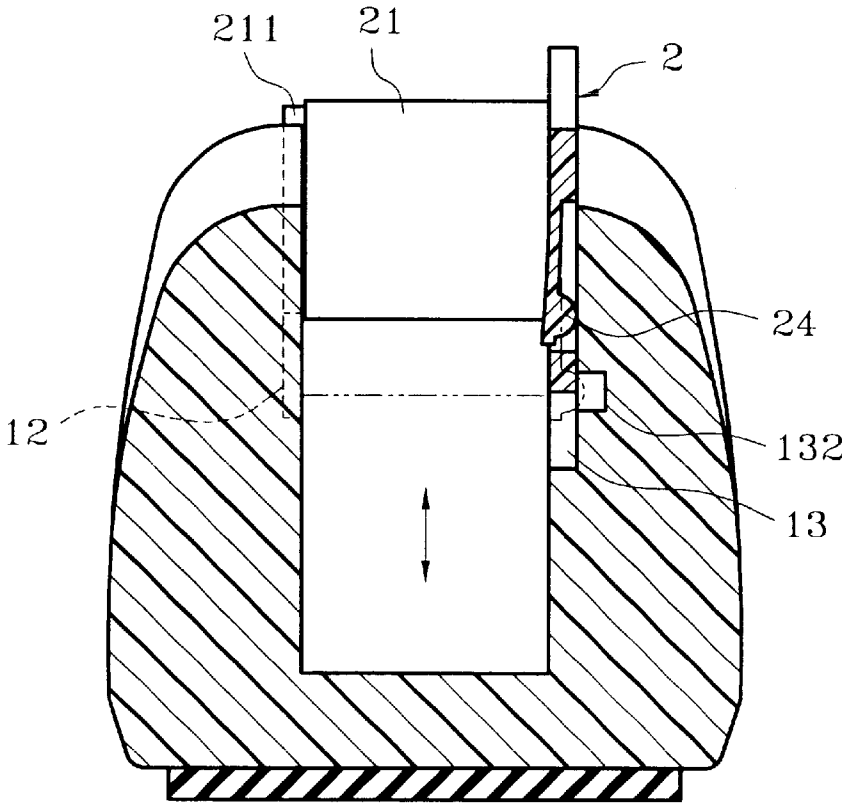
FIG. 4 is a cutaway sectional view of this invention taken along line 4—4 in FIG. 2.
Figure 5:
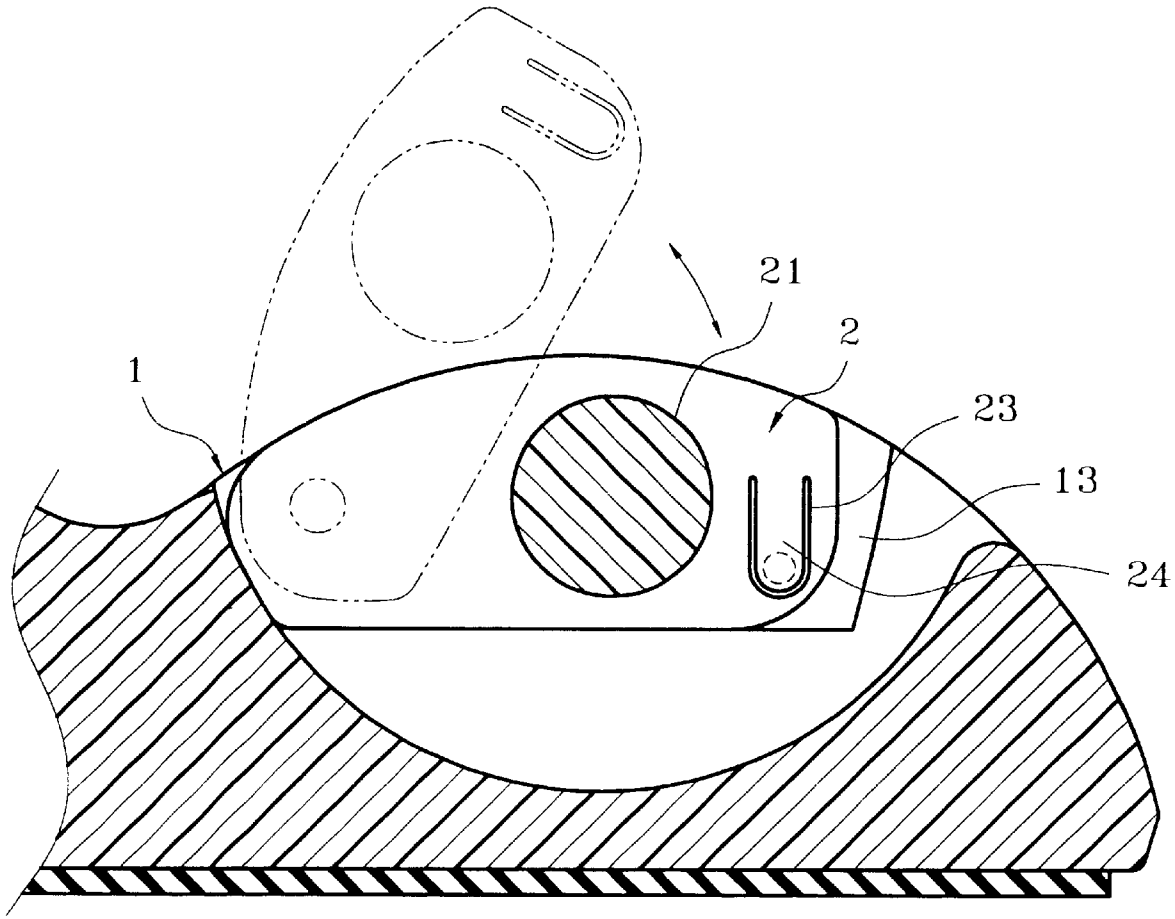
FIG. 5 is a cutaway sectional view taken along line 5—5 in FIG. 2 showing action mode of this invention.
Figure 6:
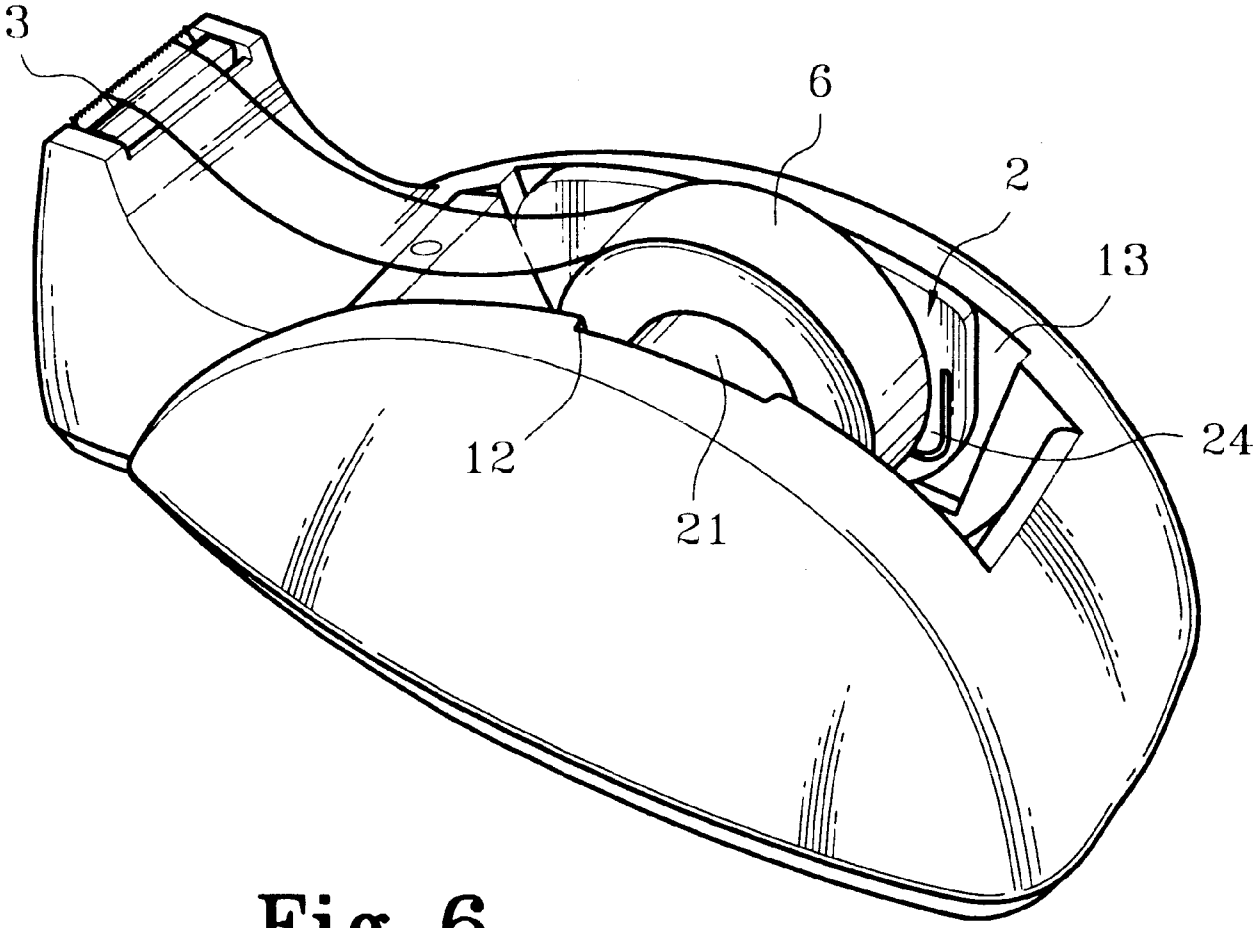
FIG. 6 is a schematic view illustrating an embodiment of this invention.

After the pivotal joint shaft 22 has been snap-retained in the pivotal joint portion 131, the bearing-shaft seat 2 is pivotally jointed with the second recess portion 13 for being turned and uplifted to make replacement of a tape reel easier. Referring to FIGS. 4, 5, 6, when loading a tape reel 6 is desired, all a user has to do is turn and uplift the bearing shaft 21 of the bearing-shaft seat 2, then hitch the tape reel 6 onto the bearing shaft 21, lower down the bearing-shaft seat 2 until the projecting portion 211 of the bearing shaft 21 reaches the skirt of the first recess portion 12, simultaneously, the bottom edge of the bearing-shaft seat 2 contacts the skirt of the second recess portion 13 and the buckling portion 24 is snap-retained in the positioning portion 132 so as to lay the bearing-shaft seat 2 stably in the store space 11, now, the user can fetch tape pieces cut with the cutting device 3. Same procedure is to be taken when replacement of the tape reel 6 is required.

Figure 7A:
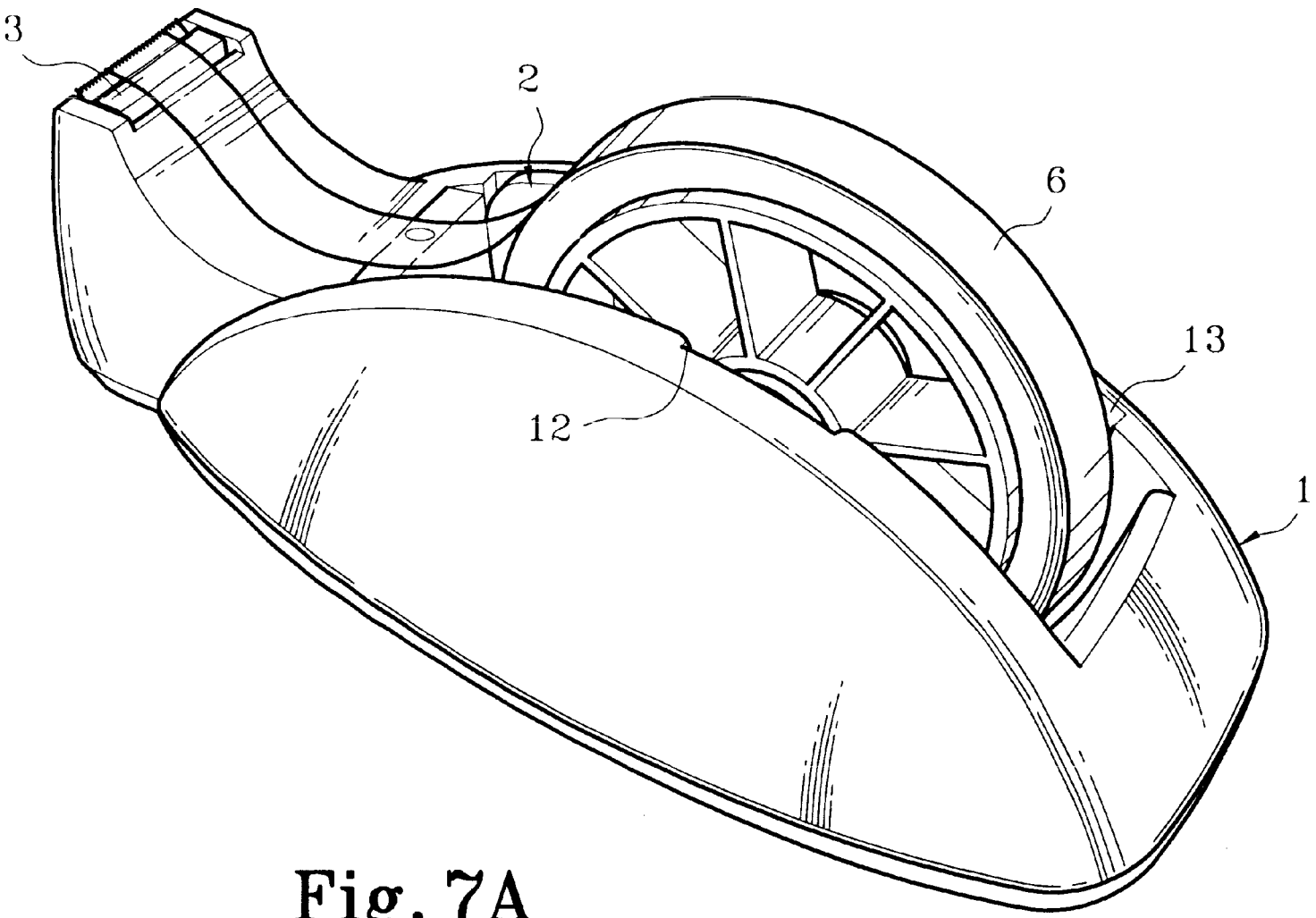
FIG. 7A is a schematic view illustrating another embodiment of this invention.
Figure 7B:
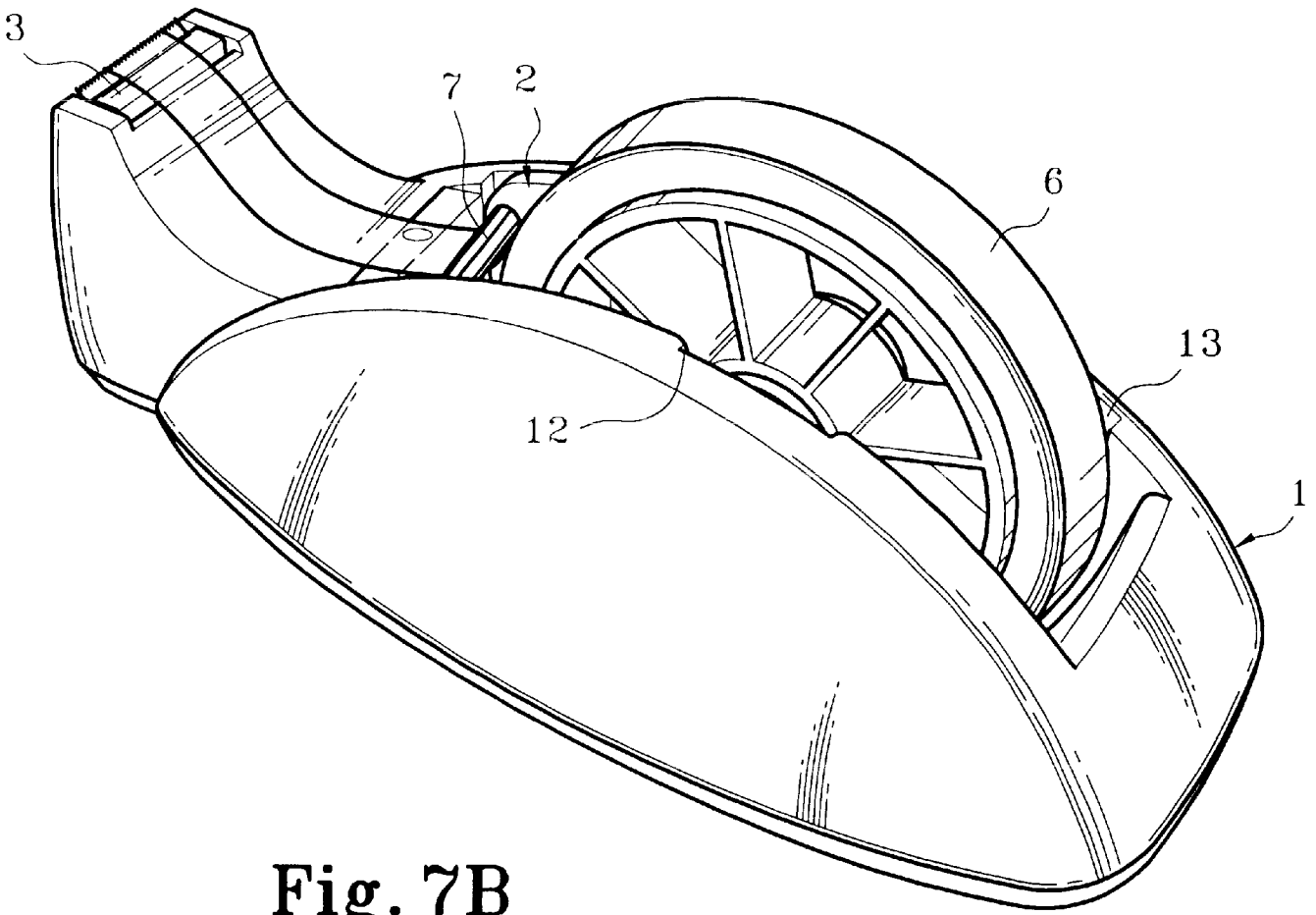
FIG. 7B is a schematic view illustrating yet another embodiment of this invention.

In other embodiments shown in FIGS. 7A, 7B, this invention may be disposed in a relatively larger tape holder directly, or an optional constraint portion 7 may be arranged on the bearing-shaft seat 2 at a position adjacent to the cutting device 3 so as to straighten the tape properly for easy fetching.

Although, this invention has been described in terms of preferred embodiments, it is apparent that numerous variations and modifications may be made without departing from the true spirit and scope thereof, as set forth in the following claims.

What is claimed is:

1. A tape holder, comprising:

a deck having a store space, wherein first and second recess portions are formed in two lateral walls of the store space;

a pivotal joint portion is disposed at one end of the second recess portion;

a bearing-shaft seat having first and second lateral faces;

a bearing shaft mounted on the first lateral face of the bearing-shaft seat;

a pivotal joint shaft which is to be pivotally jointed with the second recess portion is disposed on the second lateral face of the bearing-shaft seat;

whereby, after the pivotal joint shaft has been pivotally jointed with the pivotal joint portion of the second recess portion, the bearing-shaft seat that is mounted on the bearing-shaft seat can be turned and uplifted for loading or replacing a tape reel easily and rapidly; and wherein a scale slot is formed at one end portion of the bearing-shaft seat to form a buckling portion opposite from a second end portion of the bearing-shaft seat on which the pivotal joint shaft is located.

2. The bearing shaft according to claim 1, wherein a positioning portion is disposed at the second lateral face of the bearing-shaft seat to receive a portion of the buckling portion.

3. The bearing shaft according to claim 1, wherein a free end of the bearing shaft extends outwardly to form a projecting portion.

4. The bearing shaft according to claim 1, wherein a spherical face is formed at a free end of the pivotal joint shaft.

5. The bearing shaft according to claim 1, wherein an optional constraint portion is disposed on the bearing-shaft seat.

* * * * *